United States Patent [19]

Tanaka et al.

[11] Patent Number: 4,706,344

[45] Date of Patent: Nov. 17, 1987

[54] BUTTON ASSEMBLY

[75] Inventors: Akira Tanaka; Hirokazu Watanabe, both of Kurobe, Japan

[73] Assignee: Yoshida Kogyo K. K., Tokyo, Japan

[21] Appl. No.: 921,528

[22] Filed: Oct. 22, 1986

[30] Foreign Application Priority Data

Oct. 22, 1985 [JP] Japan ..... 60-161764

[51] Int. Cl.[4] ..... A44B 1/42

[52] U.S. Cl. ..... 24/94; 24/90 E; 24/95; 24/673

[58] Field of Search ..... 24/95, 94, 90 C, 90 E, 24/93, 106, 673, 674

[56] References Cited

U.S. PATENT DOCUMENTS

| | | | |
|---|---|---|---|
| 610,662 | 9/1898 | Radcliffe | 24/94 |
| 618,868 | 2/1899 | Hall | 24/95 |
| 1,182,857 | 5/1916 | Reid | 24/673 |
| 1,279,923 | 9/1918 | Simek | 24/90 C |
| 1,463,236 | 7/1923 | White | 24/95 |
| 1,661,616 | 3/1928 | Merzinger | 24/95 |
| 1,707,169 | 3/1929 | Merzinger | 24/90 E |
| 1,930,611 | 10/1933 | Freter | 24/94 |
| 1,985,758 | 12/1934 | Barratt | 24/95 |
| 2,018,105 | 10/1935 | White | 24/95 |

FOREIGN PATENT DOCUMENTS

| | | | |
|---|---|---|---|
| 2708104 | 8/1978 | Fed. Rep. of Germany | 24/95 |
| 59-66418 | 5/1984 | Japan . | |

*Primary Examiner*—Victor N. Sakran

*Attorney, Agent, or Firm*—Hill, Van Santen, Steadman & Simpson

[57] ABSTRACT

A button assembly includes a hollow button body having a garment-engaging base portion through which a shank of an eyelet is inserted into the botton body for being staked on the base portion to join the button body with the eyelet. The base portion includes a plurality of retaining ribs projecting into the interior of the button body for retaining thereon an annular curled edge of the shank when the eyelet is axially compressed. The ribs stiffen the base portion and increases the effective thickness of the base portion with the result that the shank can be joined with the button body by a relatively small rivetting force because the end portion of the shank to be deformed becomes short. With the interiorly projecting ribs, the base portion has a planar outer surface engageable flatwise against a garment fabric so that the button assembly can be attached neatly onto the garment fabric without any damage or wrinkles on the garment fabric around the button assembly.

10 Claims, 8 Drawing Figures

BUTTON ASSEMBLY

BACKGROUND OF THE INVENTION

1. Field of the Invention:

The present invention relates to a button assembly including a button body and an eyelet adapted to be joined together to attach the button assembly to a garment fabric.

2. Prior Art:

Japanese Utility Model Laid-open Publication No. 59-66418 discloses, as reillustrated here in FIG. 8, a button assembly comprising a socket element 10 for snap buttons which includes a plurality of angularly spaced arcuate ridges 11 projecting axially outwardly from an annular base plate 12 of a saucer-shaped socket body 13 of the socket element 10. With the ridges 11 thus provided, the base plate 12 is structually stengthened and has an increased effective thickness so that a free end of the shank of a capped cyelet 14 can be staked or curled on the interior surface of the base plate 12 by a relatively small clinching force when the socket element 10 is to be attached to a relatively thin garment fabric 15.

The disclosed socket element 10 thus constructed, however, has various drawbacks, as described below.

When the eyelet 14 is axially compressed to join with the socket body 13, the arcuate ridges 11 are forced into the garment fabric 15 to pull a portion of the garment fabric 15 radially inwardly toward the center of the socket body 13 with the result that wrinkles are created on the garment fabric 15 around the eyelet 14. With the wrinkled portion thus created, a garment becomes unsightly as a whole. Since the garment fabric 15 is relatively thin, the ridges 11 tend to penetrate such thin garment fabric 15, thereby lowering the fastening strength between the socket element 10 and the garment fabric 15. Such penetration of the ridges 11 makes the effective thickness of the base plate 12 smaller than the expected value with the result that a large clinching force is required to stake the eyelet shank on the base plate 12 because the end portion of the eyelet shank to be curled up onto the base plate 12 becomes long.

Another disadvantage is in that during a batch treatment of the button bodies 13, such as plating in a barrel or orientating in a parts-feeder's hopper, the outwardly projecting ridges 11 hit against the outer surface of another socket body 13, thereby damaging the latter. Furthermore, with the outwardly projecting ridges 11, the socket body 13 has a relatively high profile and hence is likely to be damaged by laundering.

SUMMARY OF THE INVENTION

It is accordingly a general object of the present invention to provide a button assembly having structual features which overcome or substantially eliminate the foregoing drawbacks of the prior button assembly.

A more specific object of the present invention is to provide a button assembly having a button body and an eyelet that can be firmly joined together by a relatively small clinching force without causing any damage or wrinkles on a garment around the button assembly.

Another object of the present invention is to provide a button assembly having a button body which has a relatively low profile and does not have any objectionable projection on its exterior surface.

According to the present invention, a button assembly includes a button body adapted to be joined with an eyelet to attach the button assembly to a garment fabric. The button body includes a hollow cylindrical hub, an annular base portion extending inwardly from an end of the hub, and a plurality of retaining ribs projecting axially from the annular base portion into the interior of the button body, the ribs being disposed around the central axis of the annular base portion at equal angular intervals. The eyelet includes a hollow cylindrical shank for piercing through the garment fabric and then being inserted into the interior of the button body, the shank having a distal end portion plastically deformable into an annular curled edge abutting against said retaining ribs when the eyelet is axially compressed to join with the button body. The ribs on the base portion stiffen the latter to prevent any undersirable deformation thereof. With the ribs, the base portion has an increased effective thickness with the result that the shank's distal end portion to be curled up on the base portion becomes short, thus enabling the eyelet shank to be staked on the base portion by a smaller rivetting force.

Many other advantages, features and other objects of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 7:
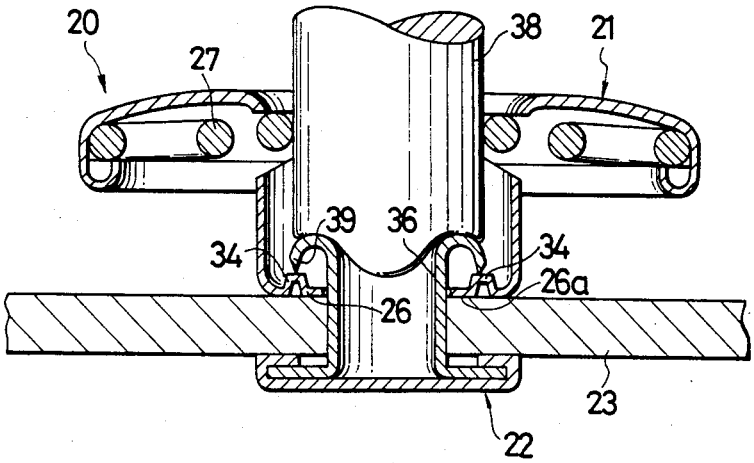
FIG. 7 is an axial cross-sectional view of the button body and eyelet of FIG. 1 as they are joined together to form a button assembly.
Figure 8:
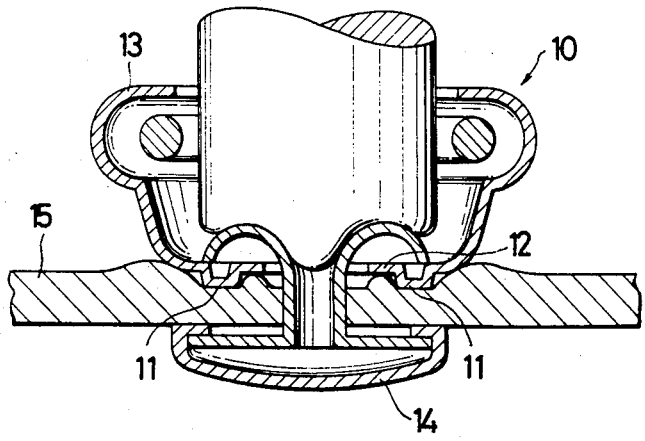
FIG. 8 PRIOR ART
FIG. 8 is a view similar to FIG. 7, showing a prior button assembly.

The present invention is particularly useful when embodied in a socket element assembly for anap buttons, such as shown in FIG. 7, generally indicated by the reference numeral 20. The socket element assembly 20 comprises a socket member 21 of a generally hat-like shape and a capped eyelet 22 joined together to attach the socket element assembly 20 to a garment fabric 23. It should be noted however that this invention is also hightly effective when embodied in a button assembly of the type having a hollow button body of a generally hat-like shape adapted to be attached to a garment fabric by an eyelet.

Figure 1:
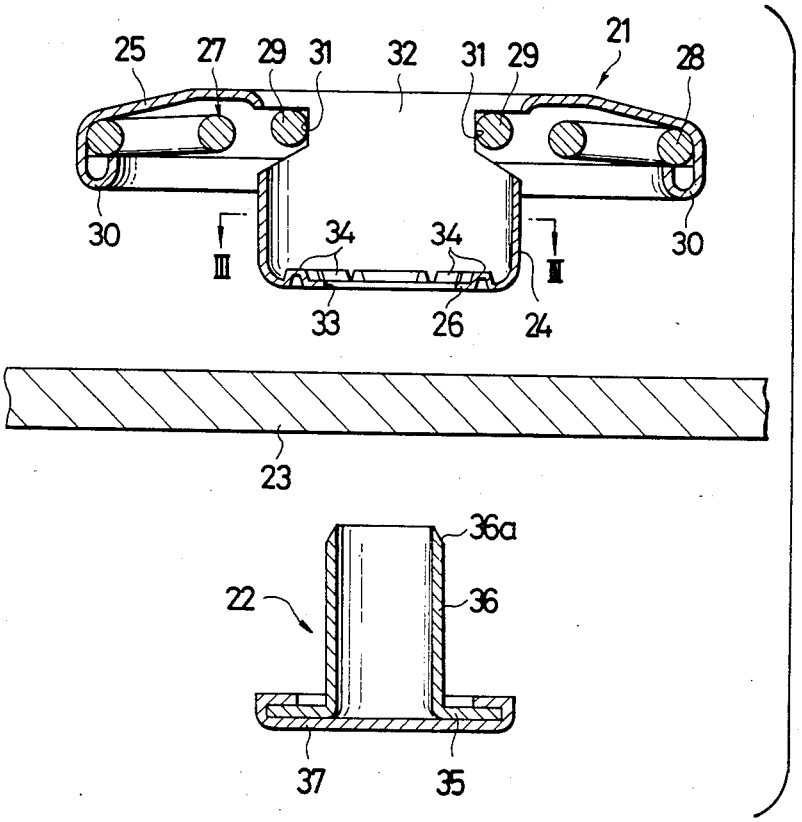
FIG. 1 is an axial cross-sectional view of a button body and an eyelet embodying the present invention, the view showing these parts before they are joined together to form a button assembly.

As shown in FIG. 1, the socket member 21 is made of metal and includes a hollow cylindrical hub 24, an annular head portion 25 extending outwardly from an upper end of the hub 24, and an annular base portion 26 extending inwardly from a lower end of the hub 24. The socket member 22 further includes a spring retainer 27 held on the head portion 25 for releasably holding a mating stud member to couple a snap button (neither shown).

Figure 2:
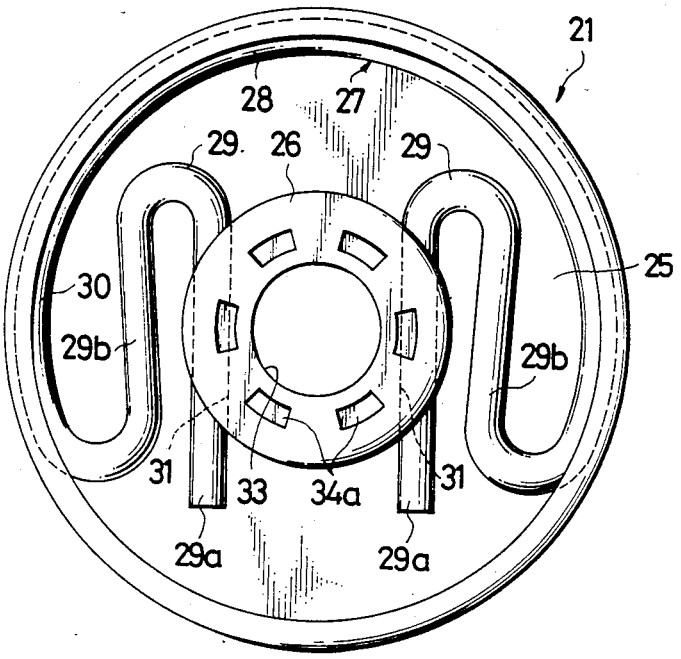
FIG. 2 is a bottom view of the button body shown in FIG. 1.

The spring retainer 27 comprises a resilient wire of a circular cross section and it includes, as shown in FIG. 2, an arcuate central leg portion 28 and a pair of opposed retaining portions 29, 29 on opposite ends of the leg portion 28. The arcuate leg portion 28 extends along an outer peripheral portion of the head portion 25 and is firmly gripped by an annular curled rim 30 of the head portion 25, the leg portion 28 extending beyond a half of the entire circumference of the rim 30. The rim 30 faces downwardly toward the lower end of the hub 24 and hence the spring retainer 27 is concealed by the head portion 25 except part of the retaining portions 29. The retaining portions 29 have a generally U-shape and they are disposed inwardly of the arcuate leg portion 28 in symmetric relation to each other about the central axis of the socket member 21. The U-shaped retaining portions 29 have opposed inner arms **29*a*, 29*a* extending substantially parallel to one another, and outer arms 29*b*, 29*b* connected with the opposite ends of the arcuate leg portion 28. The inner arms 29*a* of the respective retaining portions 29 are received in a pair of diametrically opposed circumferential notches 31 defined in the hub 24 adjacent to the upper end of the latter. Due to the resiliency of the U-shaped retaining portions 29, the inner arms 29*a* are normally urged against the notched portions 31 of the hub 24 to project into the interior 32 of the socket member 21, the arms 29*a* being retractable away from the interior 32 of the socket member 21 when the non-illustrated stud member is forced into the socket member 21**.

Figure 3:
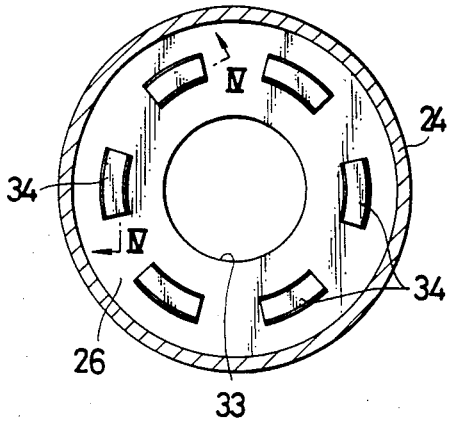
FIG. 3 is an enlarged cross-sectional view taken along line III—III of FIG. 1.
Figure 4:
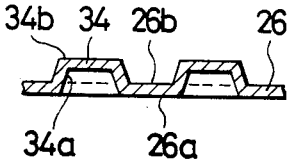
FIG. 4 is a cross-sectional view taken along line IV—IV of FIG. 3.

As shown in FIGS. 1 and 3, the annular base portion 26 has a central hole or aperture 33 and a plurality of retaining ribs 34 projecting into the interior 32 of the socket member 21. The ribs 34 extend concentrically around the aperture 33 and are angularly spaced at equal angular intervals. Each of the ribs 34 is in the shape of part of an annulus extending around the aperture 33. The ribs 20 are formed by pressing certain parts out of the base portion 26. Therefore, each of the ribs 34 provides a groove **34*a* opening to a planar outer surface 26*a* of the base portion 26 and an opposite ridge 34*b* projecting from a planar inner surface 26*b* of the base portion 26 toward the upper end of the hub 24, as shown in FIG. 4**.

The eyelet 22 is made of metal and includes, as shown in FIG. 1, an annular base 35 and a hollow cylindrical shank 36 extending substantially perpendicularly from the base 35 for piercing through the garment fabric 23 and then through the central aperture 33 of the base portion 26 for being inserted into the interior 32 of the socket member 21. The eyelet 22 further includes a cap 37 fitted over the base 35.

For attachment of the eyelet 22 to the socket member 21, the shank 36 of the eyelet 22 is forced through the garment fabric 23 into the aperture 33 of the socket member 21. Then, a hammer tool 38 (FIG. 7) of a known construction is introduced into the interior 32 of the socket member 21 until the end of the hammer tool 38 is held against a distal end **36*a* (FIG. 1) of the shank 36 projecting into the socket member 21. With the cap 37 backed up by a suitable support (not shown), the hammer tool 38 is driven under an impact force toward the shank 36 until the end 36*a* of the shank 36 is spread radially outwardly into an annular curled edge 39 (FIG. 7) abutting against the retaining ribs 34 of the socket member 21. The retaining ribs 34 on the base portion 26 stiffen the latter to prevent any objectionable deformation thereof. With such ribs 34, the base portion 26 has a relatively large effective thickness so that the eyelet shank 36 can be deformed by a relatively small riveting force because the shank's end 36*a* to be bent into the curled edge 39 becomes short. This construction is particularly useful when the socket member 21 is to be attached to a relatively thin garment fabric. During this attachment, the planar outer surface 26*a* of the base portion 26 engages flatwise against the garment fabric 23 and provides a large gripping area so that the garment fabric 23 is free from any wrinkle around the socket element assembly 20. Another advantageous result attained by the ribs 34 is that the socket member 21** is low in profile and hence sightly in appearance, is prevented from being damaged on its exterior surface during a batch treatment, such as plating in a barrel or orientation in a parts feeder's hopper.

Figure 5:
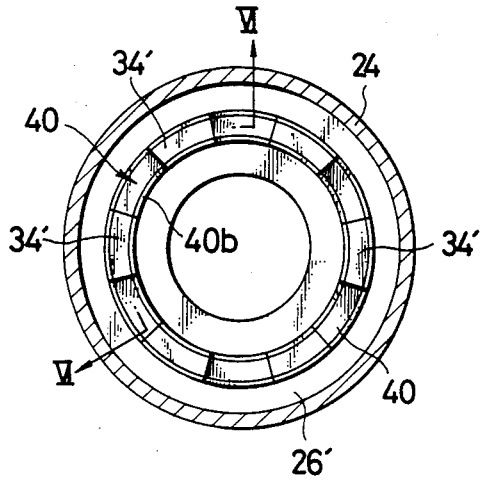
FIG. 5 is a view similar to FIG. 3, showing a modification according to the present invention.
Figure 6:
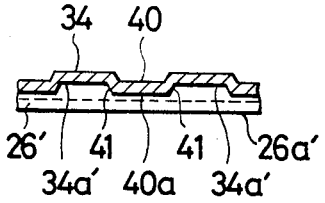
FIG. 6 is a cross-sectional view taken along line VI—VI of FIG. 5.

The base portion 26 may be modified as shown in FIGS. 5 and 6. A modified base portion 26' is substantially the same as the base portion 26 shown in FIG. 3 with the exception that it further includes a plurality of gripping ribs 40 each extending contiguously between every adjacent pair of the retaining ribs 34', the gripping ribs 40 being lower than the retaining ribs 34'. The retaining and gripping ribs 34', 40 are simultaneously formed by pressing an annular part out of the base portion 26' so that each gripping rib 40 provides a recess **40*a* (FIG. 6) opening to the planar outer surface 26*a'* of the base portion 26' and an opposite ridge 40*b* (FIG. 5) projecting into the interior of the socket body. The recess 40*a* communicates with the grooves 34*a'* of the two adjacent retaining ribs 34' via a pair of gripping steps 41. The steps 41 are engageable with a part of the garment fabric which has been forced into the grooves 34*a* ' and the recesses 40*b*** when the socket member and the eyelet is joined. This interlocking engagement is effective to prevent the socket member from rotating with respect to the garment fabric.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A button assembly for attachment to a garment fabric, comprising:

(a) a button body including a hollow cylindrical hub, a head portion extending radially outwardly from one end of said hub, and an annular base portion extending inwardly from the other end of said hub, said annular base portion having a plurality of retaining ribs projecting axially therefrom toward said one end of said hub and extending around the central axis of said annular base portion at equal angular intervals; and (b) an eyelet adapted to be joined with said button body to attach the latter to the garment fabric, said eyelet including a base and a hollow cylindrical shank extending substantially perpendicularly from said base for piercing through the garment fabric and then being inserted into the interior of said button body, said shank having a distal end portion plastically deformable into an annular curled edge abutting against top ends of the respective retaining ribs when said eyelet is axially compressed to join with said button body.

2. A button assembly according to claim 1, said base portion having a planar outer surface facing away from said one end of said hub and engageable flatwise against the garment fabric.

3. A button assembly according to claim 1, said base portion having a central aperture through which said shank is receivable into said button body, each of said retaining ribs being in the shape of part of an annulus extending concentrically around said aperture.

4. A button assembly according to claim 1, each of said ribs having a groove facing away from said one end of said hub and a ridge projecting toward said one end of said hub.

5. A button assembly according to claim 1, said button body comprising a socket member for a snap button and including a spring retainer held on said head portion, said spring retainer having a pair of opposed retaining portions normally disposed in, and resiliently retractable from, the interior of said hub socket member.

6. A button assembly according to claim 5, said spring retainer being formed of a resilient wire and having an arcuate central leg portion extending between said retaining portions, said head portion having an annular curled rim firmly engaging said arcuate leg portion.

7. A button assembly according to claim 6, said retaining portions having a generally U-shape and connected at their one arms with opposite ends of said central leg portion.

8. A button assembly according to claim 7, the other arms of said U-shaped retaining portions extending parallel to one another.

9. A button assembly according to claim 6, said annular curled rim projecting toward said other end of said hub, said hub having a pair of diametrically opposed peripheral notches for receiving respectively therein said retaining portions of said spring retainer.

10. A button assembly for attachment to a garment fabric, comprising:

(a) a button body including a hollow cylindrical hub, a head portion extending radially outwardly from one end of said hub, and an annular base portion extending inwardly from the other end of said hub, said annular base portion having a plurality of retaining ribs projecting axially therefrom toward said one end of said hub and extending around the central axis of said annular base portion at equal angular intervals each of said ribs having a groove facing away from said one end of said hub and a ridge projecting toward said one end of said hub; and (b) an eyelet adapted to be joined with said button body to attach the latter to the garment fabric, said eyelet including a base and a hollow cylindrical shank extending substantially perpendicularly from said base for piercing through the garment fabric and then being inserted into the interior of said button body, said shank having a distal end portion plastically deformable into an annular curled edge abutting against said retaining ribs when said eyelet is axially compressed to join with said button body, said base portion further including at least one ripping rib disposed between every adjacent pair of said retaining ribs projecting into the interior of said button body, said griping rib being lower than said retaining ribs and having a recess communicating with the grooves of said adjacent two retaining ribs through a pair of gripping steps extending between said gripping rib and said retaining ribs.

* * * * *